US011745910B2

(12) United States Patent
Kiessner et al.

(10) Patent No.: US 11,745,910 B2
(45) Date of Patent: Sep. 5, 2023

(54) SYSTEMS AND METHODS FOR PACKAGING PRODUCTS

(71) Applicant: Packsize LLC, Salt Lake City, UT (US)

(72) Inventors: Hanko Kiessner, Salt Lake City, UT (US); John Paul Alpine, Broomfield, CO (US)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 17/499,389

(22) Filed: Oct. 12, 2021

(65) Prior Publication Data

US 2022/0119148 A1 Apr. 21, 2022

Related U.S. Application Data

(60) Provisional application No. 63/092,241, filed on Oct. 15, 2020.

(51) Int. Cl.
*B65D 5/42* (2006.01)
*B65B 59/00* (2006.01)

(52) U.S. Cl.
CPC ..... *B65D 5/4212* (2013.01); *B65B 59/00* (2013.01); *B65B 2210/04* (2013.01); *B65D 2203/02* (2013.01)

(58) Field of Classification Search
CPC B65B 57/12; B65B 59/00; B65B 5/02; B65B 2210/04; B65D 5/4212; B65D 2203/02
See application file for complete search history.

(56) References Cited

U.S. PATENT DOCUMENTS 6,721,762 B1 * 4/2004 Levine ..... G06Q 10/04 707/999.102
7,530,210 B2 * 5/2009 McGuinness, Jr. ... B65B 59/003 53/504
8,868,230 B2 * 10/2014 Tschanz ..... B29C 64/386 700/217
9,818,070 B2 * 11/2017 Pettersson ..... G06Q 10/043
9,828,128 B1 * 11/2017 Linnell ..... B65B 57/00
9,896,231 B2 * 2/2018 Pettersson ..... B65B 67/02
(Continued)

FOREIGN PATENT DOCUMENTS

WO 2019/060129 A1 3/2019

OTHER PUBLICATIONS

International Search Report and Written Opinion received for PCT Patent Application No. PCT/US21/054715, dated Mar. 1, 2022, 12 pages.

*Primary Examiner* — Thomas M Wittenschlaeger
(74) *Attorney, Agent, or Firm* — WORKMAN NYDEGGER

(57) ABSTRACT

Customized boxes for packaging one or more items therein can have item placement indicia printed, applied, or projected thereon. The boxes can include a plurality of side wall panels and a plurality of flaps extending from the plurality of sidewall panels. The plurality of flaps can be configured to form top and bottom surfaces of the customized boxes. The item placement indicia can be printed, applied, or projected on an interior surface of one or more of the side wall panels. The item placement indicia represent desired placements for the one or more items to be packaged in the customized boxes.

16 Claims, 8 Drawing Sheets

(56) References Cited

U.S. PATENT DOCUMENTS

| | | | | |
|---|---|---|---|---|
| 9,914,278 | B2 * | 3/2018 | Pettersson | B31B 50/006 |
| 10,002,207 | B2 * | 6/2018 | Pettersson | B65B 59/001 |
| 10,011,387 | B1 | 7/2018 | Payauys | |
| 10,287,047 | B2 * | 5/2019 | Zeilstra | G06T 7/60 |
| 10,402,890 | B2 * | 9/2019 | Pettersson | G06Q 10/08 |
| 10,940,965 | B2 * | 3/2021 | Sytema | B65D 25/06 |
| 11,034,118 | B2 * | 6/2021 | De Boer | B65B 5/024 |
| 11,136,149 | B2 * | 10/2021 | Que | B65B 5/06 |
| 11,401,057 | B2 * | 8/2022 | Kiessner | B65D 21/0209 |
| 11,514,386 | B1 * | 11/2022 | Soles | G06Q 10/083 |
| 11,620,591 | B2 * | 4/2023 | Capoia | G06Q 10/08 705/337 |
| 2011/0010250 | A1 * | 1/2011 | Brooks | G06Q 30/02 705/14.69 |
| 2013/0000252 | A1 * | 1/2013 | Pettersson | B65B 5/024 348/46 |
| 2013/0247519 | A1 | 9/2013 | Clark et al. | |
| 2017/0217620 | A1 | 8/2017 | Zeilstra | |
| 2018/0050828 | A1 * | 2/2018 | Sytema | B65B 5/06 |
| 2018/0050833 | A1 * | 2/2018 | Sytema | B65B 5/028 |
| 2018/0134421 | A1 * | 5/2018 | Ponti | B65B 49/02 |
| 2018/0265228 | A1 * | 9/2018 | Hagestedt | G06F 30/17 |
| 2020/0223570 | A1 | 7/2020 | Lamb et al. | |
| 2022/0119148 | A1 * | 4/2022 | Kiessner | B65B 57/12 |
| 2022/0212827 | A1 * | 7/2022 | Van Hunsel | B65B 5/024 |

* cited by examiner

30

32

| Item | $D_x$ | $D_y$ | $D_z$ | Weight | Orientation | . . . |
|---|---|---|---|---|---|---|
| AA | 20 | 10 | 3.5 | 0.5 | | |
| BB | 16 | 7 | 12 | 1.5 | | |
| CC | 8 | 8 | 11.5 | 0.5 | | |
| DD | 5 | 5 | 13.5 | 0.25 | | |
| EE | 11.5 | 4 | 10 | 1.25 | | |
| FF | 1.75 | 11 | 16 | 0.125 | | |
| GG | 20 | 20 | 36 | 3 | | |
| HH | 14.5 | 13 | 5 | 1 | z | |
| II | 5 | 20 | 6.5 | 0.75 | | |
| JJ | 6 | 12 | 4 | 14.5 | | |
| KK | 13.5 | 12 | 10 | 5.75 | | |
| LL | 5 | 8.5 | 2.5 | 1.25 | | |
| MM | 7 | 17 | 8 | 3.25 | | |
| NN | 14 | 18 | 21 | 9.25 | x | |
| OO | 0.75 | 15 | 9 | 0.5 | | |
| PP | 15 | 6 | 4 | 1 | | |
| QQ | 6.5 | 5 | 6 | 0.25 | | |
| RR | 6 | 0.75 | 9 | 0.1 | | |

⋮

*FIG. 2*

40

XYZ Corp
999 Westview Highway
Modesto, CA 93530
Phone: 209-555-5555
Fax: 209-555-5556

PURCHASE ORDER

DATE: 1/1/2010
CUSTOMER: 123

| CUSTOMER: |
|---|
| ABC, LLC |
| 998 Central Ave |
| Modesto, CA 93530 |
| Phone: 209-555-4444 |
| Fax: 209-555-4445 |

| SHIP TO: |
|---|
| ABC, LLC |
| 998 Central Ave |
| Modesto, CA 93530 |
| Phone: 209-555-4444 |
| Fax: 209-555-4445 |

42

| ITEMS | QUANTITY | UNIT PRICE | TOTAL |
|---|---|---|---|
| AA | 1 | $ x.xx | |
| CC | 1 | $ x.xx | |
| EE | 1 | $ x.xx | |
| FF | 1 | $ x.xx | |
| HH | 1 | $ x.xx | |
| II | 1 | $ x.xx | |
| KK | 1 | $ x.xx | |

| | |
|---|---|
| SUBTOTAL | |
| TAX RATE | |
| TAX | |
| S&H | |
| OTHER | |
| **TOTAL** | |

FIG. 3

SYSTEMS AND METHODS FOR PACKAGING PRODUCTS

CROSS-REFERENCE TO RELATED APPLICATIONS

This application claims priority to and the benefit of U.S. patent application Ser. No. 63/092,241, filed Oct. 15, 2020, and entitled Systems and Methods for Packaging Products, the disclosure of which is incorporated herein by this reference in it entirety.

BACKGROUND

1. Technical Field

Exemplary embodiments of the disclosure relate to systems, methods, and devices for packaging products. More specifically, exemplary embodiments relate to providing packing instructions for packing one or more items in a box by providing or displaying indicia representative of the one or more items on one or more interior surfaces of the box.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping on hand a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the to-be-shipped items and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although custom sized and manufactured boxes can potentially alleviate the inconveniences associated with stocking standard sized shipping supplies, reduce the amount of space required for storing such shipping supplies, and reduce the overall cost for shipping supplies and shipping charges, there still remains room for improvement in the custom box industry. When standard sized boxes are used, a packer typically selects a box size that will allow for the items to be easily placed inside of the box without having to pay particular attention to the order or orientation of the items. This typically results in significant open or void space within the box that is usually filled with dunnage (e.g., paper, foam, air pillows, etc.). Because custom sized boxes are typically made so the interior dimensions thereof generally correspond to the dimensions of the items to be packed therein (e.g., to reduce void space and dunnage requirements), additional care may be required of a packer to ensure that the to-be-packed items are placed inside of the custom box in a particular order and/or orientation. If the to-be-packaged items are placed inside of the box in alternative orders and/or orientations, the items may not fit fully within the box.

While there are current systems and methods used for instructing packers how to pack items in custom sized boxes, such systems and methods can be challenging for packers to understand or interpret. For instance, packing instructions, either written or pictorial) may be printed on a paper or displayed on a screen. To be able to correctly pack the items, the packers must be able to both comprehend the packing instructions on the paper or screen and translate that into placement of the items in the box in the correct order and orientation. One or both of these steps can be challenging for packers. Additionally, it can take an undesirable amount of time for some packers to comprehend and follow the packing instructions to correctly pack the items.

Accordingly, there remains room for improvement when it comes to providing instructions for packing items in custom sized boxes.

BRIEF SUMMARY

Exemplary embodiments of the disclosure relate to systems, methods, and devices for packaging products. More specifically, exemplary embodiments relate to providing packing instructions for packing one or more items in a box by providing or displaying indicia representative of the one or more items on one or more interior surfaces of the box.

For instance, one embodiment is directed to a customized box for packaging one or more items therein. The customized box includes a plurality of side wall panels and a plurality of flaps extending from the plurality of sidewall panels. The plurality of flaps are configured to form top and bottom surfaces of the customized box. The customized box also includes item placement indicia disposed on an interior surface of one or more side wall panels of the plurality of side wall panels. The item placement indicia represent a desired placement of at least one item of the one or more items to be packaged in the customized box.

According to another embodiment, a method for packaging items includes identifying one or more items to be packaged together, accessing an informational store and retrieving dimensional attribute information about each of the one or more items, arranging the one or more items into a virtual arrangement, wherein arranging the one or more items is performed using the dimensional information retrieved from the informational store, and producing a customized package template sized particularly for the one or more items when the one or more items are arranged and positioned consistent with the virtual arrangement. Producing the customized packaging template includes forming one or more cuts and/or creates in a template material to create a template with a plurality of side wall panels and a plurality of flaps extending from the plurality of side wall panels, applying item placement indicia on at least one of the side wall panels, the item placement indicia representing a desired placement of at least one item of the one or more items, and erecting the template into a box. The method also includes placing the one or more items into the box according to the virtual arrangement, using the item placement indicia as a guide for the placement of the at least one item in the box.

In still another embodiment, a method for packaging items includes identifying one or more items to be packaged together, accessing an informational store and retrieving dimensional attribute information about each of the one or more items, arranging the one or more items into a virtual arrangement, wherein arranging the one or more items is performed using the dimensional information retrieved from the informational store, and producing a customized package template sized particularly for the one or more items when the one or more items are arranged and positioned consistent with the virtual arrangement. Producing the customized packaging template includes forming one or more cuts and/or creates in a template material to create a template with a plurality of side wall panels and a plurality of flaps extending from the plurality of side wall panels and erecting the template into a box. The method also includes projecting item placement indicia on at least one of the side wall panels, the item placement indicia representing a desired placement of at least one item of the one or more items, and placing the one or more items into the box according to the virtual arrangement, using the projected item placement indicia as a guide for the placement of the at least one item in the box.

In another example embodiment, a method for packaging items includes identifying one or more items to be packaged together, accessing an informational store and retrieving dimensional attribute information about each of the one or more items, virtually arranging the one or more items into a virtual arrangement, wherein virtually arranging the one or more items is performed using the dimensional information retrieved from the informational store, producing a customized package template sized particularly for the one or more items when the one or more items are arranged and positioned consistent with the virtual arrangement, providing access to the virtual arrangement to a robot, using the robot, placing the one or more items into the box according to the virtual arrangement, using the virtual arrangement as a guide for the placement of the at least one item in the box.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which:

FIG. 2 illustrates a store of product dimension attribute information;

FIG. 3 illustrates a purchase order for a variety of products included within the product information store of FIG. 1;

DETAILED DESCRIPTION

The embodiments described herein generally relate to systems, methods, and devices for packaging products. More specifically, exemplary embodiments relate to providing or displaying indicia representative of one or more items on one or more interior surfaces of a box as instructions for where the one or more items should be placed in the box during a packaging process.

While the present disclosure will describe details of embodiments with reference to specific configurations, the descriptions are illustrative and are not to be construed as limiting the scope of the present invention. Various modifications can be made to the illustrated configurations without departing from the spirit and scope of the invention as defined by the claims. For better understanding, like components have been designated by like reference numbers throughout the various accompanying figures.

As used herein, the terms "template," "box template," and "packaging template" shall refer to a substantially flat stock of material that can be folded into a box-like shape. A box or packaging template may have notches, cutouts, divides, and/or creases that allow the box or packaging template to be bent and/or folded into a box. Additionally, a box or packaging template may be made of any suitable material, generally known to those skilled in the art. For example, cardboard or corrugated paperboard may be used as the template material. A suitable material also may have any thickness and weight that would permit it to be bent and/or folded into a box-like shape.

Figure 1:
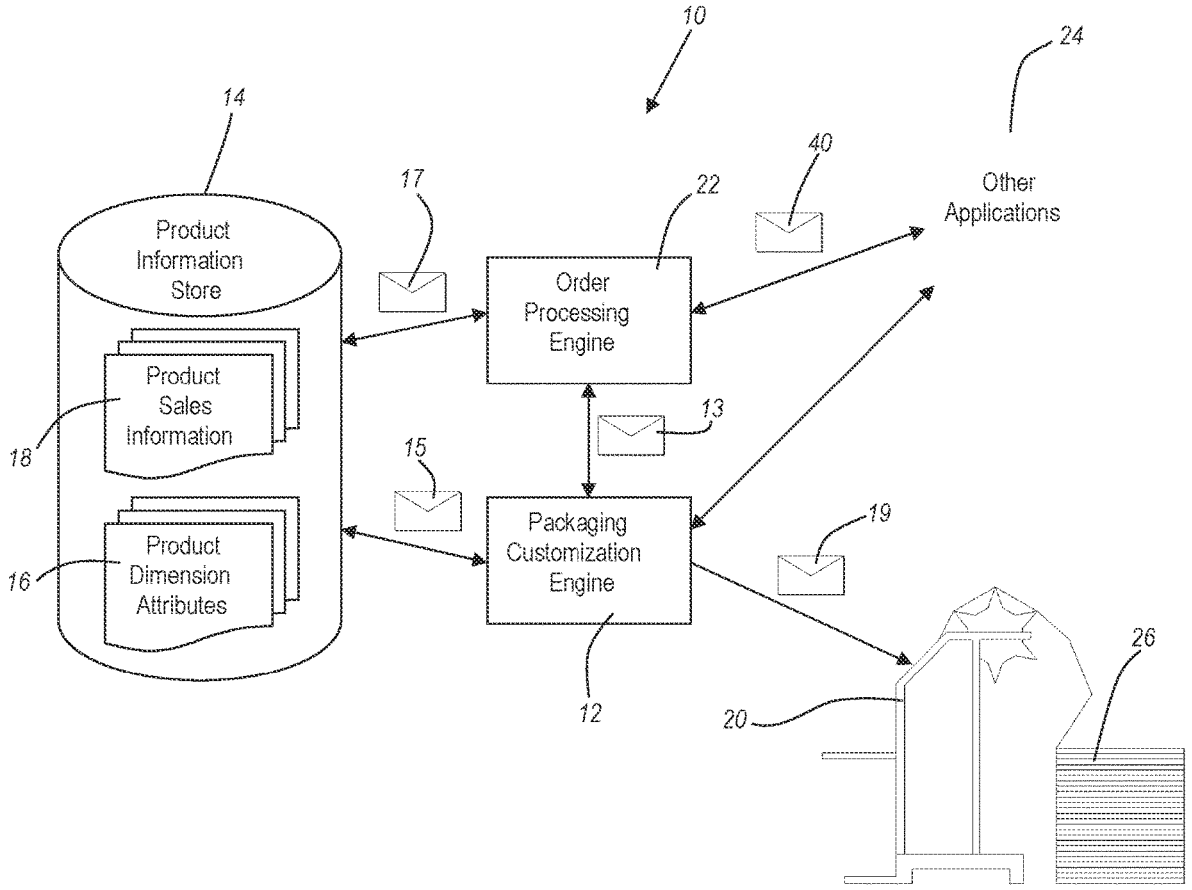
FIG. 1 illustrates a system architecture including a packaging customization engine, a product information store, and a packaging machine.

With reference now to FIG. 1, one example embodiment of an on-demand packaging system 10 is illustrated and includes a packaging customization engine 12 communicatively coupled to a product information store 14. In the illustrated embodiment, product information store 14 includes a variety of types of information, including product dimension attributes 16 and product sales information 18. It should be appreciated in view of the disclosure herein, that while product dimension attributes 16 and product sales information 18 are illustrated as separate collections of information, they may also be integrated into a single file, table, or other collection of data. Accordingly, product information store 14 is merely one example of a suitable information store, and any suitable type of data store may be used. For example, product information store 14 may include a relational database, a hierarchical database, a network database, an in-memory database, an object-oriented database, a data warehouse, any other suitable store or database for maintaining information, or a combination thereof. Indeed, in some embodiments, product information store 14 may comprise a single physical database, whereas in other embodiments, product information store 14 may be distributed over multiple different physical locations.

In the illustrated embodiment, packaging customization engine 12 is further coupled to a packaging machine 20. Packaging machine 20 is one example of an on-demand packaging machine that can be used to produce packaging of different types and varieties according to inputs provided manually and/or by packaging customization engine 12. For example, as described in greater detail herein, packaging machine 20 may receive input from packaging customization engine 12 to produce a template for a package that is customized for one or more products.

As further illustrated in FIG. 1, packaging customization engine 12 is optionally coupled to an order processing engine 22. According to one example embodiment, on-demand packaging system 10 is utilized in connection with a retailer or manufacture that provides one or more different products. In one example embodiment, such a retailer may receive an order for one or more products at order processing engine 22. For example, a consumer at a retail store may request a certain quantity of products, and a salesman may enter the purchase information directly into order processing engine 22, or into one of the other applications 24 which may then communicate the information to order processing engine 22 (e.g., using message 40). In another example, a customer may enter purchase information directly, such as by using a web browser or other application 24 on a computing device that is network connected to order processing engine 22.

Regardless of the manner of receipt of the order information, order processing engine 22 may receive a request that one or more items have been ordered by a particular consumer and are to be stored and/or delivered to such consumer. When order processing engine 22 receives the request, order processing engine 22 may also access product information store 14. For example, order processing engine 22 may send a message 17 requesting access to product sales information 18, in response to which a response is provided that includes information about pricing, availability, shipping costs, and the like associated with such products ordered. Optionally, order processing engine 22 may also communicate information it has received from product information store 14 to the consumer. For example, order processing engine may send to the consumer an order summary, purchase order, pricing information, delivery tracking information, and the like, any of which may include information from product sales information 18. Product sales information 18 may also be updated by order processing engine 18 to add, delete, change, or otherwise edit a new or existing purchase order.

According to one embodiment, after order processing engine 22 has received an order for one or more items, order processing engine 22 communicates with packaging customization engine 12 to indicate that packaging for the ordered items is needed. Such communication may occur at any time after order processing engine 22 has received the order. For example, order processing engine 22 may send notice of the order to packaging customization engine 12 at the time the order is received, or at the time the ordered items are ready for shipment.

Information provided by order processing engine 22 to packaging customization engine 12 may take any form and, in one embodiment, takes the form of an electronic message 13 that requests customized packaging engine 12 produce a customized packagesuch as a boxthat will be used for the storage and/or shipment of the items ordered (e.g., ordered through message 40). In sending such a request 13, order processing engine 22 may send information about the products ordered directly to packaging customization engine 12, may send a reference to product sales information 18, may send an order number usable by packaging customization engine 12 to access the order in product sales information 18, or may provide information in any other way that allows packaging customization engine 12 to identify which products have been ordered.

Further, according to some embodiments, it may not be necessary for order processing engine 22 to provide any information about the order to packaging customization engine 12. For example, a shipment system (not shown) may connect with order processing engine 22. At the time shipment is desired, the shipment system may send a request for customized packaging to packaging customization engine 12, such that no direct communication from order processing engine 22 to packaging customization engine 12 is necessary. It should also be appreciated that while order processing engine 22, packaging customization engine 12, and the shipment system are shown and/or described separately, one or more may also be integrated into a single system or engine. For example, order processing engine 22 may also include packaging customization engine 12 as a part thereof.

With continued reference to FIG. 1, when packaging customization engine 12 receives request 13 for customized packaging, or some other information identifying products ordered, packaging customization engine 12 may access product dimension attributes 16 and/or obtain additional information about the ordered products. For example, packaging customization engine 12 can send a query message 15 to product information store 14 to request dimensional information about the ordered products. For example, and as discussed in more detail with regard to FIG. 2, product attributes 16 that are provided in response to query message 15 may include information about the dimensions and/or weight of each item that is a part of the same order. Such attributes may include height, width, length, radius of curvature, desired packaging orientation, and other information that can be used by packaging customization engine 12 to develop an arrangement of the products ordered so that the overall dimensions for a customized package design can be calculated.

Once packaging customization engine 12 has accessed the dimensional attributes of the products and developed an arrangement, packaging customization engine 12 may also design a packaging template. In particular, packaging customization engine 12 may use the height, length, width, and/or other information of the created arrangement to identify the footprint of a box or other package needed to enclose the arrangement of items as calculated by packaging customization engine 12, and then design a template corresponding to such footprint. Such a design may, however, be instead performed by packaging machine 20. For example, packaging customization engine 12 may develop an arrangement of ordered items, and then supply the dimensions of the arrangement or of desired packaging to packaging machine 20 (e.g., by sending message 19), to allow packaging machine 20 to design the packaging template.

Packaging machine 20 may also have access to packaging materials 26 of one or more types and/or sizes. For example, according to one embodiment, packaging machine 20 is fed fanfold corrugated cardboard of one or more sizes. Based on the dimensions of the package needed for a particular order, packaging machine 20 can then selectively feed enough of the fanfold corrugated cardboard through packaging machine 20 and make any necessary cuts, creases, perforations, score lines, and the like thereon to create a desired box template. As will be discussed below, item placement indicia may optionally be printed/applied on the box template and the box template may then be assembled manually, or automatically, and the ordered products can be inserted therein according to the printed/applied item placement indicia. Alternatively, the box template may be assembled manually, or automatically, and the item placement indicia may be projected onto the interior of the box and the ordered products can be inserted therein according to the projected item placement indicia.

While on-demand packaging system 10 has been discussed primarily with reference to satisfying an order from a customer, it should be appreciated in view of the disclosure herein that this is merely exemplary, and that in other embodiments packaging customization engine 12 may operate without any order being placed. For example, packaging customization engine 12 may receive information about a variety of objects that the owner or operator of system 10 desires to store, package, or ship, independent of any particular order. Indeed, system 10 may be used to produce customized packaging of any type once it is known which items are to be packaged, regardless of the reason such packaging is requested.

Turning now to FIG. 2, an example store of product attributes 16 is provided. In particular, FIG. 2 illustrates a table 30 into which various types of information about different items or products can be stored. In the example in FIG. 2, table 30 includes an item column 32 identifying each product for which attribute information has been collected. The information in item column 32 may in turn include some type of identification of each product. In the illustrated example, products AA-RR are shown; however, the vertical ellipses are provided to indicate that additional products may also be included.

Additionally, the type of information used to identify a product may vary. Such information may include, for example, a product name, product number, model number, SKU number, or any other unique identifier of an item. For each such item, different types of information may then be included that may be used by the packaging customization engine to virtually arrange the different items so that a packaging template can be produced. An arrangement may be virtual by, for example, producing a simulated model of the to-be-packaged items in a particular arrangement, so that when the items are physically collected, they can be arranged in a physical manner that corresponds to the simulated model.

Among other information, table 30 may include dimensional information about the footprint of the items to be included within the packaging. For example, the columns with the headings $D_x$, $D_y$, and $D_z$ may be used to denote the length, width, and height of the items. Using this information, the packaging customization engine can then create a virtual arrangement of all the products in an order to determine the overall dimensions of the information.

Other dimensional information beyond the mere rectilinear length, width, and height information may also be used. For example, in some embodiments, information about curves, irregularities, voids, and/or other dimensions of the various items may be stored so that it can be accounted for as packaging customization engine 12 produces an optimal arrangement of items. In another embodiment, table 30 may store, or reference, three-dimensional models of the items to be packaged. As a result, packaging customization engine 12 may then access the product models and provide a virtual assembly using the models themselves to optimize the arrangement of items as discussed herein.

In some embodiments, the weight of the items may also be provided in attribute table 30. Weight information may be used, for example, in producing an optimal arrangement of items. For instance, packaging customization engine 12 may virtually arrange the items to place the heavier items at or near the bottom of the arrangement and/or lighter items at or near the top of the arrangement.

In still other embodiments, table 30 may include orientation information about a particular item. For example, if a particular item should be oriented so that a particular direction faces upward, that direction may be specified in table 30. In particular, table 30 shows two items that have specific orientations. Product HH, for example, is indicated to require that the "z" direction be oriented in a particular manner, and information about product NN indicates that the "x" direction should be oriented in a specific manner. Additional information may further indicate what orientation is requested or required, or the orientation information in table 30 may be understood to have a particular meaning (e.g., the z-direction of product HH should be oriented vertically and/or the x-direction of product NN should be oriented horizontally). The orientation information is, however, optional and may or may not be used in arranging items for customized packaging.

It should be appreciated that FIG. 2 is merely one example of a suitable store of product dimensional attribute information, and that table 30 may include a variety of other types of information. Indeed, as illustrated in FIG. 2, horizontal ellipses indicate that numerous other attributes may also be stored in table 30. Such attributes may relate to dimensional information or other attributes of associated items. For example, additional information may include information about curvatures or irregularities in a product, whether the product has one or more cavities into which other products can be nested, whether a cavity has an opening, a hollow center, an irregularity, etc., as well as other information such as pricing, inventory status, or order information.

With reference now to FIG. 3, an exemplary purchase order 40 is illustrated in which a customer ABC, LLC of a vendor XYZ Corp. has placed an order for various products identified within table 30 of FIG. 2. In FIG. 3, it can be seen in table 42 that 7 different items have been ordered. Purchase order 40 of FIG. 3 is merely exemplary of any purchase order or other request that certain items be packaged together; however, the particular example in FIG. 3 will be used in more detail below.

As noted above, packaging customization engine 12 can use product dimension attributes 16 of the to-be-packaged items to create a virtual arrangement of the items. Thereafter, packaging customization engine 12 and/or packaging production machine 20 can design a packaging template that can be erected into a box that is sized to fit the arrangement of the to-be-packaged items. Packaging production machine 20 can produce the packaging template from packaging materials 26. The packaging template can then be erected into a box and the to-be-packaged items can be packaged or placed inside the box according to the arrangement developed by packaging customization engine 12.

By way of example, packaging customization engine 12 may receive an order with the seven items AA-KK identified in table 42 on the purchase order 40 of FIG. 3. Packaging customization engine 12 may use product dimension attributes 16 associated with the items AA, CC, EE, FF, HH, II, and KK to create a virtual arrangement of the items. Such an arrangement may be purely virtual and does not require that the actual items be arranged, although in other embodiments, packaging customization engine 12 may access the to-be-packaged items, or models thereof, and use robotics or manual capabilities to physically arrange the to-be-packaged items. According to one example, packaging customization engine 12 may receive three-dimensional models of each of the to-be-packaged items from product information store 14 in response to query 15, and can use such three-dimensional models in performing a virtual arrangement of the items.

Figure 4:
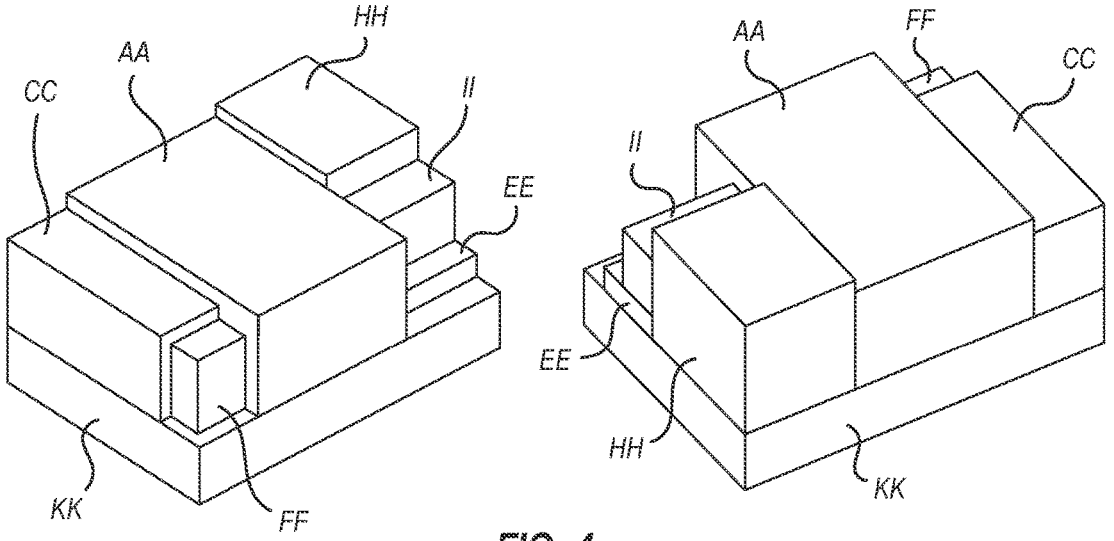
FIG. 4 illustrates front and rear perspective views of an example product configuration.

FIG. 4 illustrates front and rear perspective views of one example arrangement of the items AA, CC, EE, FF, HH, II, and KK. As can be seen in FIG. 4, item KK has the largest footprint and is placed on the bottom of the arrangement and the other items are placed on top. It will be appreciated that the illustrated arrangement is merely exemplary. The packaging customization engine 12 may produce multiple different arrangements and may select or allow a user to select one of the arrangements based on particular criteria (e.g., smallest volume, desired box type, desired box shape, amount of cardboard used to create packaging template, etc.).

After a suitable arrangement of items has been produced/selected, packaging customization engine 12 and/or packaging production machine 20 uses the product dimension attributes 16 and the virtual arrangement to calculate the overall dimensions of the virtual arrangement, and thus also determines the dimensions needed for the customized packaging needed to contain the to-be-packaged items. The desired customized packaging can optionally have a generally rectangular configuration, and the arrangement of items may accordingly optionally be optimized for such a rectangular configuration. Accordingly, determining the dimensions of the customized packaging may include packaging customization engine 12 and/or packaging production machine 20 calculating, measuring, computing, or otherwise identifying a length, width, and height of the interior of a customized package suitable to contain the arrangement of to-be-packaged items.

Once the dimensions of the customized package have been identified, packaging machine 20 may produce the customized packaging. For example, packaging customization engine 12 may calculate the maximum height, length, and width of the virtual arrangement of the items. In the event that packaging customization engine 12 calculates the dimensions of the virtual arrangement, packaging customization engine 12 can send such dimensions to packaging production machine 20.

Based upon the dimensions of the virtual arrangement, an appropriate packaging template may be designed. For example, packaging production machine 20 may design a box template suitable to provide the desired dimensions. Such a box template may generally correspond to the dimensions of the virtual arrangement, but may optionally increase the size of the customized packaging to account for deviations in size of the to-be-ordered items, to allow for internal packaging materials to be inserted, to account for differences in internal vs. external dimensions of the customized packaging, or for other reasons.

Accordingly, in one embodiment, packaging production machine 20 may itself design the packaging template. Designing the packaging template, whether performed by packaging machine 20, packaging customization engine 12, or some other entity, may include performing a calculation for a template. The template may be designed automatically by packaging machine 20, such that the amount of corrugated cardboard or other material needed is automatically determined, along with the desired locations for cuts, creases, score lines, perforations, and other features that may facilitate assembly of the package from the template into a completed package suitable to receive and hold the to-be-packaged items. For example, packaging machine 20 may feed packaging materials 26 and cut a template of the size and shape determined for the virtual arrangement of items.

Additionally, creating a custom packaging template may also include printing or otherwise applying item placement indicia on the template. The template may then be assembled manually, or automatically, and the ordered products can be inserted therein according to the printed/applied item placement indicia thereon. For instance, in one embodiment, packaging machine 20 or another component (e.g., a printer) may print or otherwise add (e.g., apply stickers, etc.) item placement indicia to the panels of the box template that will form the interior of the erected box.

Figure 5:
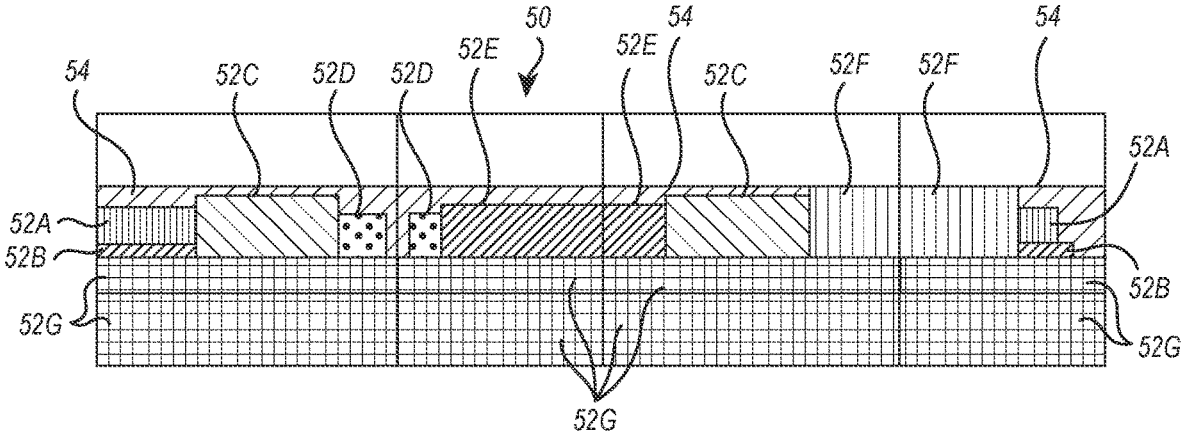
FIG. 5 illustrates an example box template for the product configuration of FIG. 4.

FIG. 5 illustrates one example embodiment of a flat, unerected box template 50 with item placement indicia 52A-52G added thereto. Each of item placement indicia 52A-52G may correspond to or have some relationship with one of items AA, CC, EE, FF, HH, II, and KK. For instance, item placement indicia 52A-52G may include outlines of the to-be packaged items AA, CC, EE, FF, HH, II, and KK, names or descriptions of the individual items, images or photos of the items, colors or numbers corresponding to each item, etc., or combinations thereof. Regardless of the specific type(s) of indicia used, the item placement indicia may provide a visual indication of where (and optionally in what orientation) each of the to-be-packaged items are to be positioned within the erected box so that the items will be arranged in the box according to the virtual arrangement discussed above. Thus, the item placement indicia may act as instructions to a packager as to where (and optionally in what orientation) each item is to be positioned in the box (according to the virtual arrangement) so as to ensure that the items fit within the box.

By way of further clarification, reference herein to items AA, CC, EE, FF, HH, II, and KK refers to the actual items or to virtual models thereon. In contrast, item placement indicia 52A-52G refer to indicia printed, projected, or other displayed on a box template or on one or more of the interior surfaces of a box. As disclosed elsewhere herein, the item placement indicia 52A-52G may also be part of a virtual model of a box or box template that may be used by a robot to identify the proper placement and/or orientation of the items AA, CC, EE, FF, HH, II, and KK when placed within a real box.

In addition to the item placement indicia, fill material indicia 54 may also be added to the template to indicate where fill material should be added within the erected box and around the items packaged therein. For instance, in one embodiment, packaging machine 20 or another component (e.g., a printer) may print or otherwise add fill material indicia to the panels of the box template to indicate the areas within the box where fill material should be added.

FIGS. 6A-6D illustrates four top perspective views of box template 50 assembled into a box 60 that is ready to be filled with the to-be-packaged items AA, CC, EE, FF, HH, II, and KK. As can be, the top of box 60 is open to enable items AA, CC, EE, FF, HH, II, and KK to be placed therein. As can also be seen, with the top of box 60 open, the item placement indicia 52A-52G and the optional fill material indicia 54 can be seen within box 60. When filling box 60, the item placement indicia 52A-52G and the optional fill material indicia 54 can be used as a guide for placement of items AA, CC, EE, FF, HH, II, and KK and optional fill material in box 60.

For instance, it can be seen in FIGS. 6A-6D that item placement indicia 52G covers the bottom interior surface and partially up each of the interior walls of box 60. The item placement indicia 52G can thereby indicate that item KK (which is associated with indicia 52G) should be placed in box 60 so as to cover the bottom interior surface and the lower portions of the interior walls thereof that include indicia 52G.

Figure 6A:
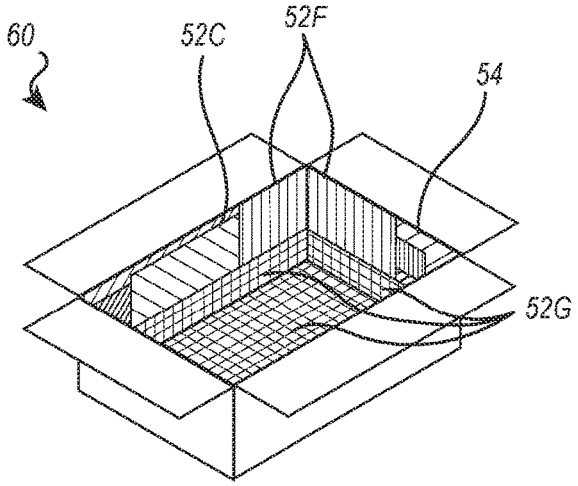
FIGS. 6A-6D illustrate perspective views of a box formed with the box template of FIG. 5.

As best seen in FIG. 6A, item placement indicia 52F is disposed on two adjacent interior walls of box 60 and above the item placement indicia 52G. Additionally, item placement indicia 52F extends to a corner of box 60 formed by the walls on which the indicia are disposed. The item placement indicia 52F thereby indicates that item HH (which is associated with indicia 52F) should be placed in box 60 on top of item KK and in the illustrated corner so as to cover the indicia 52F.

Figure 6B:
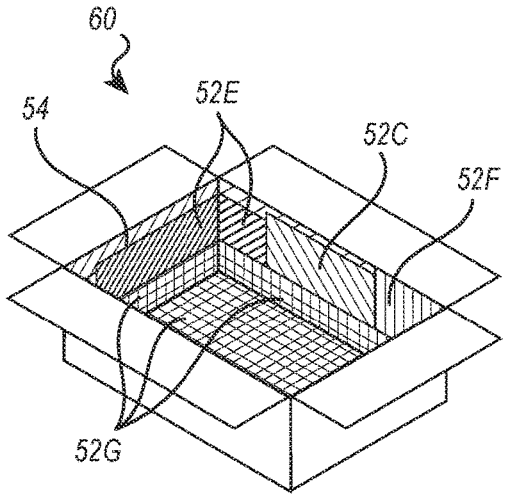

With continued reference to FIG. 6A, attention is now also directed to FIG. 6B. As can be seen in FIGS. 6A and 6B, item placement indicia 52C is disposed above item placement indicia 52G and directly adjacent to item placement indicia 52F. The item placement indicia 52C thereby indicates that item AA (which is associated with indicia should be placed in box 60 on top of item KK (which is associated with indicia 52G) and next to item HH (associated with indicia 52F).

Figure 6C:
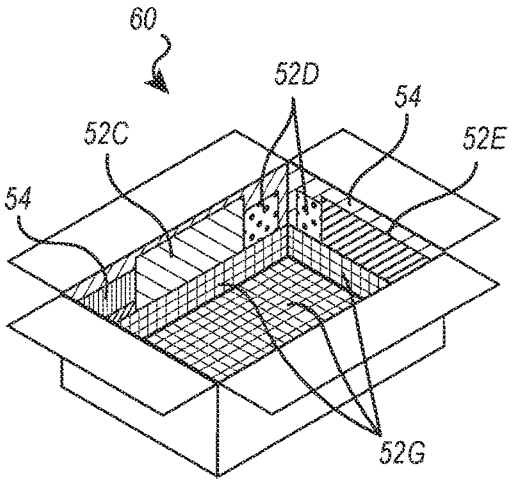
Figure 6D:
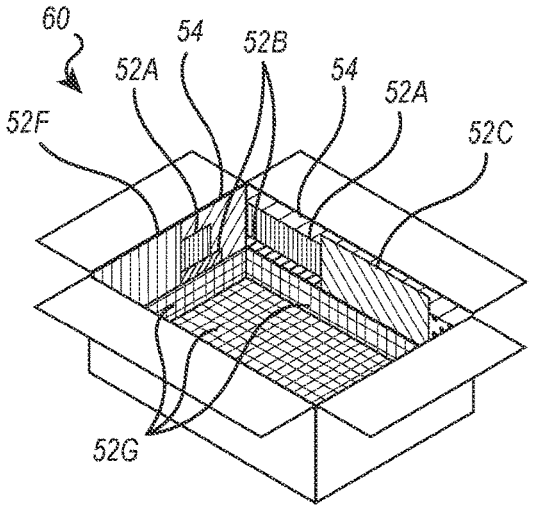
Figure 7A:
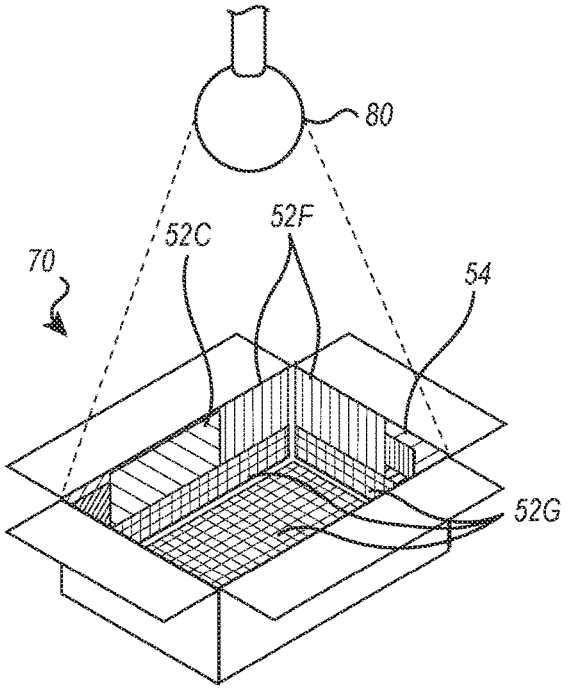
FIGS. 7A-7D illustrate perspective views of a box for the product VD configurations of FIG. 4 and an item placement indicia projector.
Figure 7B:
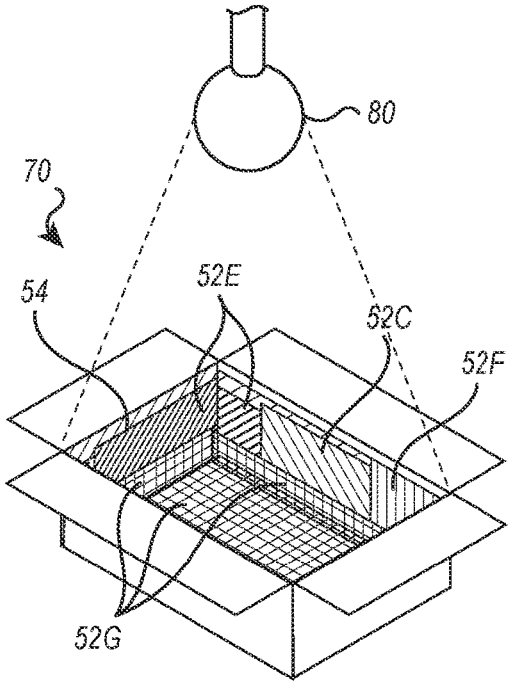
Figure 7C:
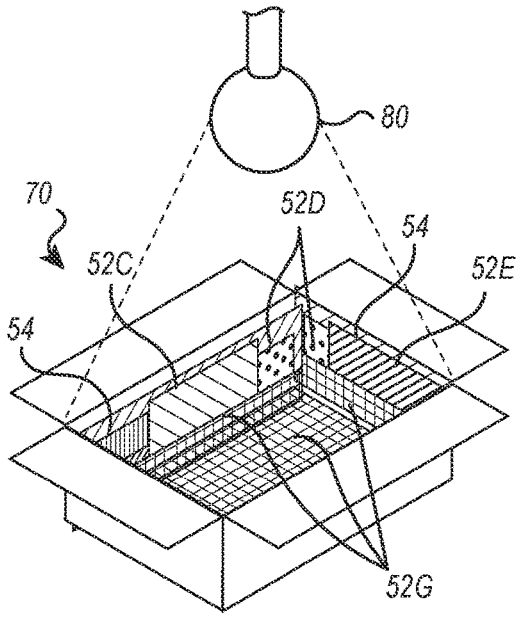
Figure 7D:
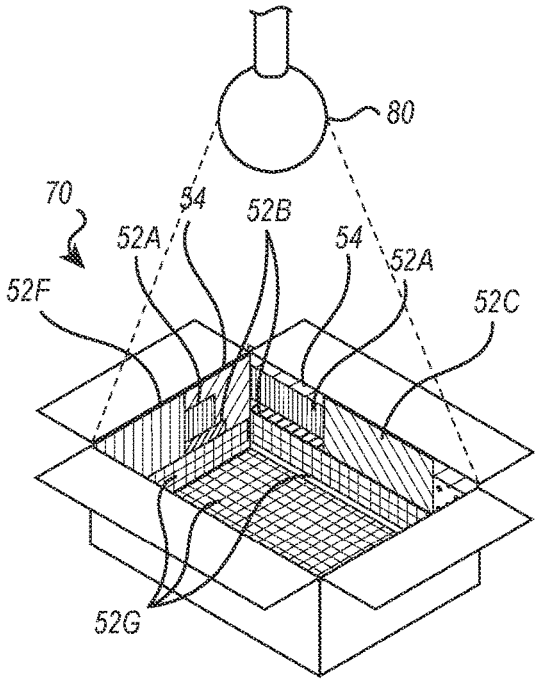

FIGS. 6C and 6D also illustrate item placement indicia 52C on an opposing interior wall of box 60. The inclusion of item placement indicia 52C on opposing interior walls of box 60 can indicate that item AA (associated with indicia 52C) should be placed in box 60 so that item AA extends between the opposing interior walls and covers item placement indicia 52C on the opposing interior walls.

Returning back to FIG. 6B, item placement indicia 52E is disposed on two adjacent interior walls of box 60, above the item placement indicia 52G, and directly adjacent to item placement indicia 52C. Additionally, item placement indicia 52E extends to a corner of box 60 formed by the walls on which indicia 52E are disposed. The item placement indicia 52E thereby indicates that item CC (which is associated with indicia 52E) should be placed in box 60 on top of item KK (associated with indicia 52G), next to item AA (associated with indicia 52C), and in the illustrated corner so as to cover the indicia 52E.

As noted above, FIG. 6C illustrates item placement indicia 52C on an interior wall of box 60 to indicate the proper placement of item AA in box 60. Additionally, FIG. 6C also illustrates item placement indicia 52D on adjacent interior side walls of box 60 to indicate the proper position of item FF (associated with indicia 52D) in box 60. In the illustrated embodiment, item placement indicia 52D are disposed above item placement indicia 52G and directly adjacent to item placement indicia 52E and 52C. The item placement indicia 52D thereby indicates that item FF (which is associated with indicia 52D) should be placed in box 60 on top of item KK (associated with indicia 52G) and next to item CC (indicated by indicia 52E) and item AA (indicated by indicia 52C).

In the illustrated embodiment, item placement indicia 52D do not extend all the way to the corner of box 60 formed by the interior walls on which item placement indicia 52D are disposed. As can be seen, there is a space between each item indicial 52D and the corner of box 60 illustrated in FIG. 6C. The illustrated spaces between the corner and the indicia 52D may indicate that item FF may not contact the walls on which the indicia 52D are disposed when item FF is positioned in box 60. Rather, item FF may be positioned within box 60 on top of item KK (associated with indicia 52G) and next to both item CC and item AA (similar to the position shown in FIG. 4). Accordingly, the space between indicia 52D and the corner of box 60 may indicate that item FF is to be offset from the corner of box 60 and/or the interior walls on which indicia 52D is disposed.

Attention is now directed to FIG. 6D, which illustrates item placement indicia 52A, 52B, among others. As illustrated, item placement indicia 52A, 52B are disposed on two adjacent interior walls of box 60 and are stacked on top of one another above the item placement indicia 52G. In the illustrated embodiment, item placement indicia 52A, 52B extend along one wall of box 60 between item placement indicia 52C and a corner of box 60. In contrast, on the other wall that includes item placement indicia 52A, 52B, item placement indicia 52A, 52B are positioned next to item placement indicia 52F and extend partially towards the illustrated corner. Item placement indicia 52A, 52B thereby indicate that items EE and II (associated with indicia 52A, 52B) should be placed in box 60 on top of item KK (associated with indicia 52G), next to items HH (associated with indicia 52G) and AA (associated with indicia 52C).

The illustrated space on the wall between the corner and the indicia 52A, 52B may indicate that items EE and II may not contact one of walls on which the indicia 52C are disposed when items EE and II are positioned in box 60. Rather, item EE and II may be positioned within box 60 on top of item KK (associated with indicia 52G) and next to both item HH and item AA (similar to the position shown in FIG. 4). Accordingly, the space between indicia 52A, 52B and the corner of box 60 may indicate that items EE and II are to be offset from the corner of box 60 and/or at least one of the walls of box 60. In other embodiments, the item placement indicia may be omitted from the walls of the box that the items do not contact when the items are placed in the box.

As can also be seen in FIGS. 6A-6D, the fill material indicia 54 can also indicate where fill material should be placed inside of box 60. For instance, fill material indicia 54 indicates that fill material should be placed in box 60 on top of items AA, CC, EE, FF, II, and KK so that the fill material is positioned between the noted items and the top surface of box 60 when box 60 is closed. Additionally, fill material indicia 54 also indicates that fill material should be placed between item FF and the adjacent walls to fill the space therebetween. Similarly, fill material indicia 54 also indicates that fill material should be placed between items EE and II and the wall from which items EE and II are offset from so as to fill the space therebetween.

In an alternative embodiment, the item placement indicia may not be printed or otherwise permanently applied to the custom packaging template. Rather, cuts, creases, and the like may be made in the packaging materials 26 to create a custom packaging template that, when erected, will have the appropriate dimensions to fit the arrangement of items discussed above. However, rather than printing or otherwise applying item placement indicia on the template, the template may be assembled, manually or automatically, and otherwise prepared to be filled. In some embodiments, once the template has been assembled into a box with an open top, item placement indicia may be projected onto the interior of the box and the ordered products can be inserted therein according to the item placement indicia projected onto the interior of the box.

FIGS. 7A-7D illustrate such an embodiment. In particular, FIGS. 7A-7D illustrate a box 70 that is sized to fit the arrangement of items illustrated in FIG. 4. While box 70 may be the same size and shape as box 60 illustrated in FIGS. 6A-6D, box 70 and box 60 are different boxes. The primary difference therebetween is that box 60 has item placement indicia 52A-52G printed or otherwise (permanently) applied thereto. In contrast, box 70 does not have item placement indicia 52A-52G printed or otherwise (permanently) applied thereto. Rather, a projection device 80 adjacent to box 70 can project item placement indicia 52A-52G onto the interior surfaces of box 70. The projected item placement indicia 52A-52G may appear similar or identical to the item placement indicia 52A-52G that is printed or otherwise (permanently) applied to box 60.

The projection device 80 may include one or more projectors that can project onto one or more of the interior surfaces of box 70 so that item placement indicia 52A-52G can be shown on each of the relevant interior surfaces. Similarly, the projection device 80 may also project fill material indicia 54 onto the relevant interior surfaces of box 70. The projection device 80, or one or more projectors thereof, may be adjusted based on the size, orientation, and/or position of the box into which the item placement indicia are projected. Such adjustments may ensure that the size, shape, or other characteristics of the item placement indicia are accurately depicted on the interior surfaces of the box.

In some embodiments, all of the item placement indicia and/or the fill material indicia may be projected onto the interior surface(s) of the box as the same time. In some embodiments, however, one or more of the item placement indicia and/or the fill material indicia may be projected onto the interior surface(s) of the box in a highlighted manner. For instance, the item placement indicia may be projected onto the interior surface(s) of the box so that a projection of a first item placement indicia associated with a first to-be-packaged item is highlighted. Once the first to-be-packaged item has been properly positioned within the box (e.g., according to the first item placement indicia), a projection of a second item placement indicia associated with a second to-be-packaged item may be highlighted, and so on for each to-be-packaged item for a particular box. Similarly, projections of fill material indicia may be highlighted when it is time to insert the associated fill material into the box. Highlighting item placement indicia and/or fill material indicia may be done if various ways. For instance, highlighting indicia may include projecting the highlighted indicia: with a brighter light, in a different color, with a secondary indicia (e.g., number, letter, symbol (e.g., star, !, etc.)), or combinations thereof.

In other embodiments, one or more of the item placement indicia and/or the fill material indicia may be projected onto the interior surface(s) of the box at a give time. For instance, the item placement indicia may be projected onto the interior surface(s) of the box one at a time. More specifically, a first item placement indicia associated with a first to-be-packaged item may be projected onto the interior surface(s) of the box. Once the first to-be-packaged item has been properly positioned within the box (e.g., according to the first item placement indicia), a second item placement indicia may be projected onto the interior surface(s) of the box, and so on for each to-be-packaged item for a particular box. Similarly, fill material indicia may be projected onto the interior surface(s) of the box at the when it is time to insert the associated fill material into the box.

Figure 8B:
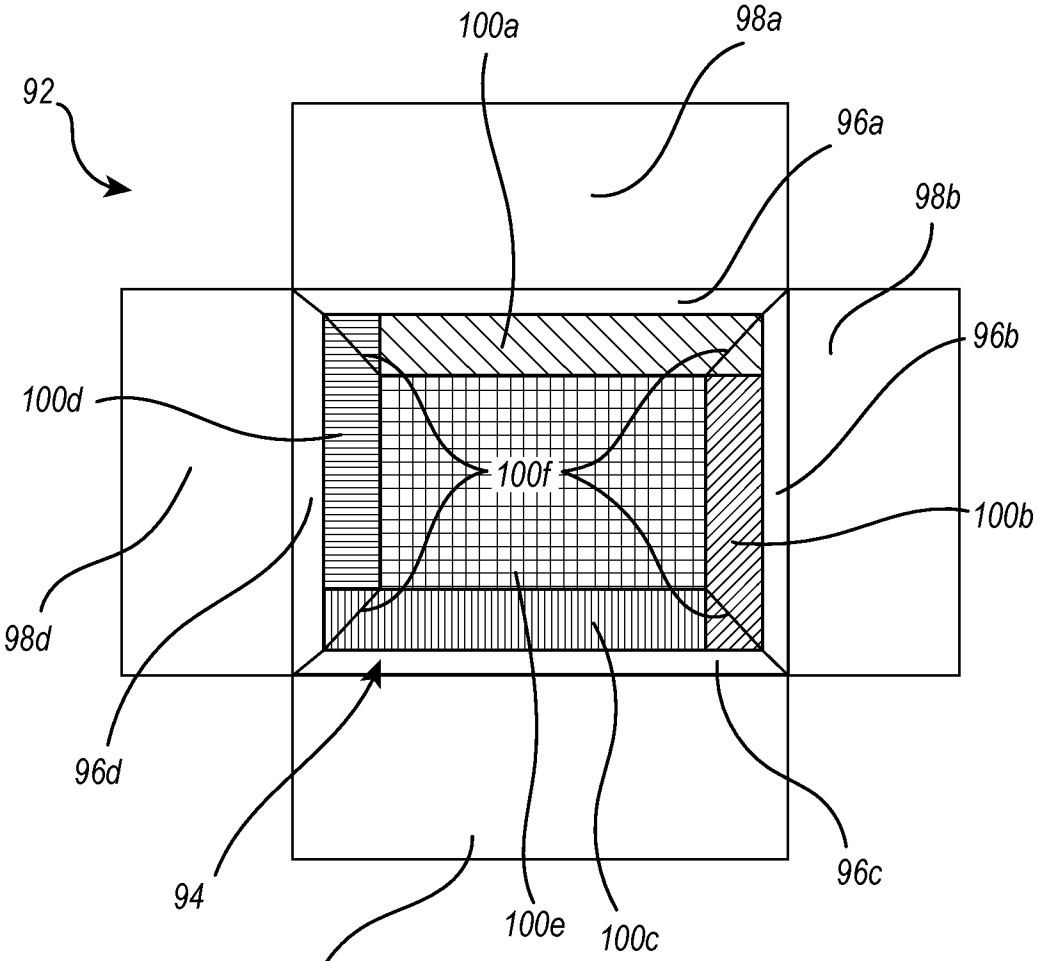
FIG. 8B illustrates a top view of an open box with item placement indicia on an interior surface thereof for the product configuration of FIG. 8A.
Figure 8A:
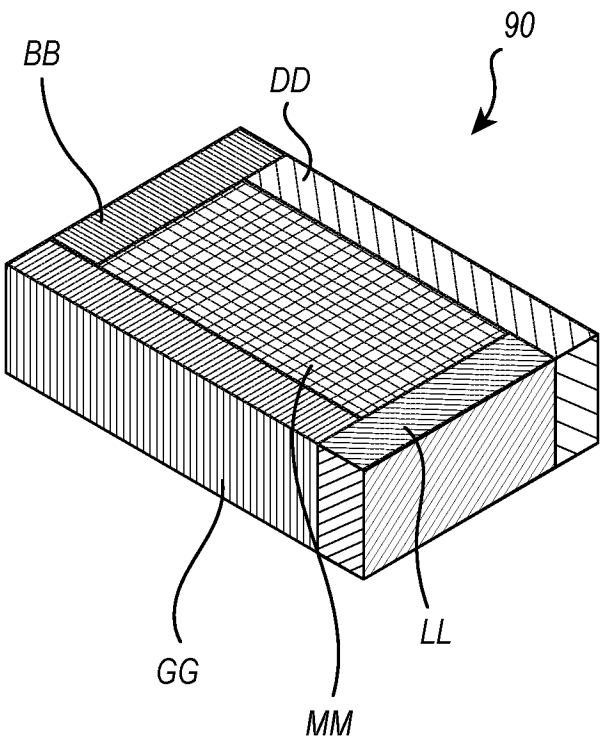
FIG. 8A illustrates a perspective view of an example product configuration.

FIG. 8A illustrates a perspective view of another example product configuration 90 of items to be packaged within a box. In the illustrated embodiment, the product configuration 90 includes items BB, DD, GG, LL, and MM. As can be seen, items BB, DD, GG, and LL are disposed around the outer sides of item MM, such that item MM is disposed within the outer footprint of the product configuration. In other words, the vertical sidewalls of item MM are at least partially covered by items BB, DD, GG, and LL and/or do not extend to the outer sides of the product configuration.

Similar to the process discussed above, after product configuration 90 has been produced/selected, packaging customization engine 12 and/or packaging production machine 20 uses the product dimension attributes of the items BB, DD, GG, LL, and MM and the virtual arrangement/product configuration to calculate the overall dimensions of the virtual arrangement/product configuration, and thus also determines the dimensions needed for a customized packaging needed to contain the to-be-packaged items when arranged in the product configuration 90.

Once the dimensions of the customized package have been identified, packaging machine 20 may produce the customized packaging as discussed above. As also discussed above, creating a custom packaging template may also include printing or otherwise applying item placement indicia on the template. The template may then be assembled manually, or automatically, and the ordered products can be inserted therein according to the printed/applied item placement indicia thereon.

FIG. 8B illustrates a top view of one example embodiment of a custom box 92 created for the product configuration 90. In the illustrated embodiment, the box 92 includes a bottom surface 94 (which can be formed by one or more flaps), sidewalls 96*a*, 96*b*, 96*c*, 96*d*, and top flaps 98*a*, 98*b*, 98*c*, 98*d*. The top flaps 98*a*, 98*b*, 98*c*, 98*d* extend from the sidewalls 96*a*, 96*b*, 96*c*, 96*d* and can be folded to form a top surface of the box 92.

Similar to the previous embodiments, the box 92 has item placement indicia 100*a*-100*f* added thereto. The item placement indicia 100*a*-100*f* may correspond to or have some relationship with one of items BB, DD, GG, LL, and MM. For instance, item placement indicia 100*a*-100*f* may include outlines of the to-be packaged items BB, DD, GG, LL, and MM, names or descriptions of the individual items, images or photos of the items, colors or numbers corresponding to each item, etc., or combinations thereof. Thus, in a manner similar to that discussed above, items BB, DD, GG, LL, and MM may be placed in the box 92 so as to cover the corresponding item placement indicia 100*a*-100*e*.

In the illustrated embodiment, the item placement indicia 100*a*-100*f* is only shown on the bottom surface 94 of the box 92. It will be appreciated, however, that item placement indicia may also or alternatively be included on the sidewalls 96*a*, 96*b*, 96*c*, 96*d* and/or the top flaps 98*a*, 98*b*, 98*c*, 98*d*, similar to the previous embodiments discussed above.

In addition to the item placement indicia 100 including names or descriptions of the individual items, images or photos of the items, colors or numbers corresponding to each item to indicate the desired placement of the items within the box 92, the item placement indicia may also include guide or shadow lines 100*f*. The use of guide or shadow lines 100*f* may be particularly useful when an item is or will be at least partially surrounding by other items within the box. When an item is to be positioned within a box with other items at least partially surrounding the item, it may be difficult or impractical to include item placement indicial on the interior surface(s) of the box 92 in a manner that will clearly indicate the intended placement of the item. Accordingly, guide or shadow lines 100*f* may be included to identify the proper location of an item that will be at least partially surrounded by other items.

In the illustrated embodiment, the guide or shadow lines 100*f* are included on the bottom surface 94 of the box 92 and extend from the corners of the box. The opposing ends of the guide or shadow lines 100*f* end where the corners of item MM should be placed in the box 92. In other words, when item MM is placed in the box 92, item MM can be placed so that the corners thereof are aligned with the ends of the guide or shadow lines 100*f*.

While the guide or shadow lines 100*f* are shown and described as extending from the corners of the box 92, it will be appreciated that this is merely exemplary. In other embodiments, the guide or shadow lines may extend from the edges of the interior surfaces away from the corners. In still other embodiments, the guide or shadow lines may not extend to the corners or edges of the box.

Furthermore, while the illustrated embodiment includes guide or shadow lines 100*f* only on the bottom surface 94, it will be appreciated that this is merely exemplary. In other embodiments, guide or shadow lines may also or alternatively be included on one or more sidewalls or top flaps. For instance, if an item is to be placed within the box with other items above and below it, may be useful to include guide or shadow lines on one or more sidewalls to indicate the intended vertical position of the item within the box and relative to the surrounding items.

Figure 9A:
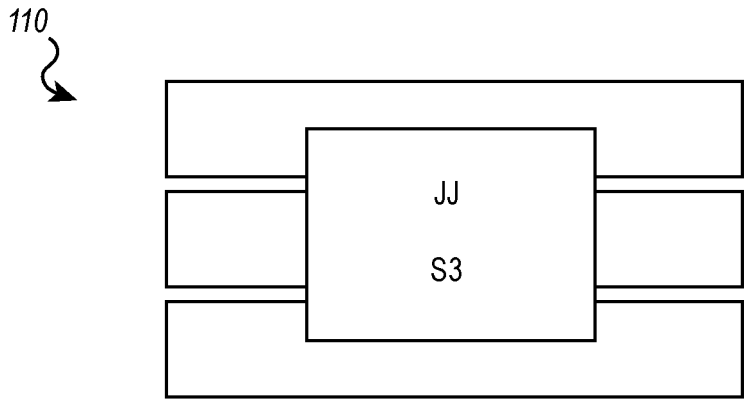
FIGS. 9A and 9B illustrate example item placement indicia.
Figure 9B:
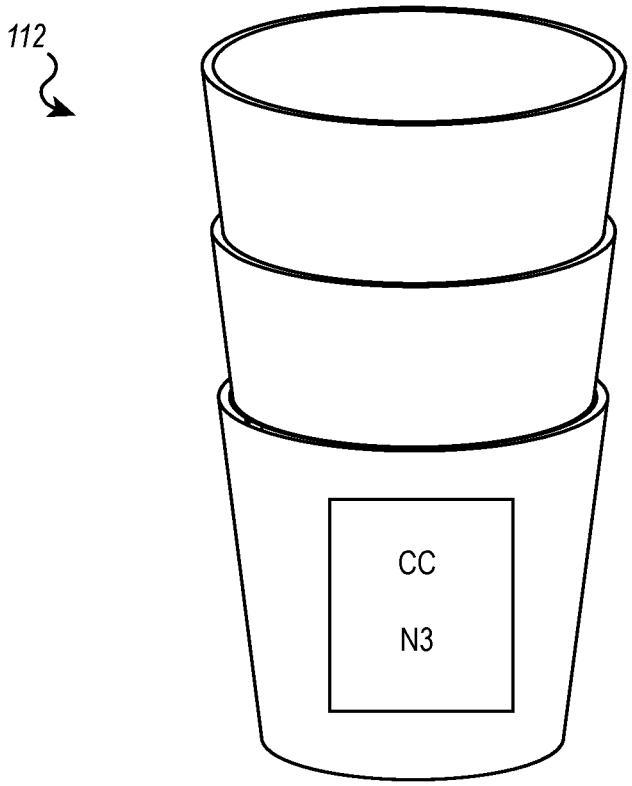

Attention is now directed to FIGS. 9A and 9B, which illustrate additional examples of item placement indicia that may be used to identify the locations of to-be-packaged items within a box. As noted above, table 30 (FIG. 2) may include information about whether an item is stackable and/or nestable. When multiple ordered items are stackable or nestable, item placement indicia may be used to indicate the ordered items may be stacked or nested together. Additionally, the item placement indicia may also indicate the number of items that are to be stacked or nested together.

FIG. 9A illustrates example item placement indicia 110 that may be used to indicate that multiple ordered items may be stacked on top of each other. For instance, if three of item JJ are part of a single order, the item placement indicia 110 may include multiple stacked shapes (e.g., rectangles, squares, ovals, etc.) that represent the items JJ. In some embodiments, number of stacked shapes may correspond to the number of stackable items (e.g., items JJ) in the order. In other embodiments, the number of stacked shapes may not correspond to the number of ordered stackable items. Rather, for instance, the number of stacked shapes may be the same (e.g., three) regardless of whether it matches the number of ordered stackable items.

The item placement indicia 110 may also indicate the number of items that are to be stacked on top of one another. For instance, as shown in FIG. 9A, the item placement indicia 110 includes "S3" to indicate that three items are to be stacked on top of one another. The number of stacked items identifier may be positioned over the stacked shapes (as shown in FIG. 9A) or may be positioned above, below, or to a side of the stacked shapes.

The items placement indicia 110 may also indicate what items are to be stacked on one another. For instance, as with the other item placement indicia described herein, the item placement indicia 110 may include a name, picture, outline, color, description, or the like that relates to the stackable items.

FIG. 9B illustrates an example item placement indicia 112 that may be used to indicate that multiple ordered items may be nested together. For instance, if three of item CC are part of a single order, the item placement indicia 112 may include multiple nested shapes (e.g., cylinders, rectangles, squares, ovals, etc.) that represent the items CC. In some embodiments, the number of nested shapes may correspond to the number of nestable items (e.g., items CC) in the order. In other embodiments, the number of nested shapes may not correspond to the number of ordered nestable items. Rather, for instance, the number of nested shapes may be the same (e.g., three) regardless of whether it matches the number of ordered nestable items.

The item placement indicia 112 may also indicate the number of items that are to be nested within one another. For instance, as shown in FIG. 9B, the item placement indicia 112 includes "N3" to indicate that three items are to be nested within one another. The number of nestable items identifier may be positioned over the nested shapes (as shown in FIG. 9B) or may be positioned above, below, or to a side of the nested shapes.

The items placement indicia 112 may also indicate what items are to be nested within one another. For instance, as with the other item placement indicia described herein, the item placement indicia 112 may include a name, picture, outline, color, description, or the like that relates to the nestable items.

As with the other item placement indicia disclosed herein, the item placement indicium 110, 112 may be printed or projected on one or more interior surfaces of a box or box template to identify to identify where in the box the stackable or nestable items should be placed and, optionally, in what orientation.

In still other alternative embodiments, the item placement and/or fill material indicia may not be printed or projected onto the custom packaging template or a box formed therefrom. Rather, a robot may be used to place the to-be-packaged items in the custom sized box according to the virtual arrangement generated by the packaging customization engine. More specifically, the erected custom sized box may be placed is a predetermined position and orientation relative to the robot. The robot may have access to the virtual arrangement of the to-be-packaged items. The robot may place each of the to-be-packaged items in the custom sized box in accordance with the virtual arrangement (e.g., the position and orientation) of each to-be-packaged item. With access to the virtual arrangement, the robot may be able to "see" the virtual item placement and/or fill material indicia (e.g., in the virtual arrangement) and place the items and/or fill material in the custom sized box according to the virtual arrangement.

In some embodiments, a box is custom sized to specifically fit a predetermined arrangement of items (e.g., the arrangement that forms the basis for the order and placement of items within the box, indicia of which may optionally be printed or projected onto the interior of the box). Accordingly, when filling the box, the items should be placed in the box in the positions indicated by virtual arrangement and/or the corresponding the item placement indicia printed or projected onto the interior of the box. In some cases, if the items are placed in the box in an alternative arrangement, the items may not fit properly within the box.

According to one example embodiment, a customized box for packaging one or more items therein includes a plurality of side wall panels, a plurality of flaps extending from the plurality of sidewall panels, the plurality of flaps being configured to form at least a top or bottom surface of the customized box, and item placement indicia disposed on an interior surface of one or more side wall panels of the plurality of side wall panels or one or more flaps of the plurality of flaps, the item placement indicia representing a desired placement of at least one item of the one or more items to be packaged in the customized box.

In some embodiments, the item placement indicia includes an outline of the at least one item.

In some embodiments, the item placement indicia includes a picture or a description of the at least one item.

In some embodiments, the item placement indicia includes a reference number or color associated with the at least one item.

In some embodiments, the item placement indicia includes one or more guide or shadow lines configured to indicate a desired placement within the box of an item that will be at least partially surrounded by other items within the box.

In some embodiments, the item placement indicia for the at least one item is disposed on at least two side walls of the plurality of side walls.

In some embodiments, the customized box also includes fill material indicia disposed on an interior surface of one or more side wall panels of the plurality of side wall panels, the fill material indicia representing a desired placement of fill material in the customized box.

In some embodiments, the fill material indicia are disposed between the item placement indicia and the top surface of the box.

In some embodiments, the fill material indicia is disposed on a first side wall between item placement indicia disposed on the first side wall and a corner of the box formed by the first side wall and a second side wall.

In another example embodiment, a method for packaging items includes identifying one or more items to be packaged together, accessing an informational store and retrieving dimensional attribute information about each of the one or more items, arranging the one or more items into a virtual arrangement, wherein arranging the one or more items is performed using the dimensional information retrieved from the informational store, producing a customized package template sized particularly for the one or more items when the one or more items are arranged and positioned consistent with the virtual arrangement, wherein producing the customized packaging template includes forming one or more cuts and/or creates in a template material to create a template with a plurality of side wall panels and a plurality of flaps extending from the plurality of side wall panels, applying item placement indicia on at least one of the plurality of side wall panels or at least one of the plurality of flaps, the item placement indicia representing a desired placement of at least one item of the one or more items, and erecting the template into a box, and placing the one or more items into the box according to the virtual arrangement, using the item placement indicia as a guide for the placement of the at least one item in the box.

In some embodiments, the method also includes calculating dimensions of the virtual arrangement.

In some embodiments, producing the customized package template comprises cutting and/or creasing the template material such that the erected box has interior dimensions that correspond to the calculated dimensions of the virtual arrangement.

In some embodiments, applying item placement indicia on at least one of the side wall panels comprises printing the item placement indicia on the at least one side wall panel or flap.

In some embodiments, the method also includes applying fill material indicia to one or more side wall panels of the plurality of side wall panels.

In some embodiments, applying the item placement indicia on at least one of the side wall panels or flaps comprises printing an outline, a picture, a description, one or more guide or shadow lines, or a combination thereof of the at least one item on the at least one side wall panel or flap.

In some embodiments, applying the item placement indicia on at least one of the side wall panels or flaps comprises printing colors and/or reference numbers associated the at least one item of the one or more items on the at least one side wall panel or flap.

In another example embodiment, a method for packaging items includes identifying one or more items to be packaged together, accessing an informational store and retrieving dimensional attribute information about each of the one or more items, arranging the one or more items into a virtual arrangement, wherein arranging the one or more items is performed using the dimensional information retrieved from the informational store, producing a customized package template sized particularly for the one or more items when the one or more items are arranged and positioned consistent with the virtual arrangement, wherein producing the customized packaging template comprises: forming one or more cuts and/or creates in a template material to create a template with a plurality of side wall panels and a plurality of flaps extending from the plurality of side wall panels, and erecting the template into a box, projecting item placement indicia on at least one of the side wall panels or flaps, the item placement indicia representing a desired placement of at least one item of the one or more items, and placing the one or more items into the box according to the virtual arrangement, using the projected item placement indicia as a guide for the placement of the at least one item in the box.

In some embodiments, the item placement indicia is projected on the at least one side wall panel or flap with a projection device disposed above the box.

In some embodiments, projecting the item placement indicia comprises projecting an outline, a picture, a description, one or more guide or shadow lines, or a combination thereof of the at least one item on the at least one side wall panel or flap.

In some embodiments, projecting the item placement indicia comprises projecting colors and/or reference numbers associated the at least one item of the one or more items on the at least one side wall panel or flap.

In some embodiments, projecting the item placement indicia comprises simultaneously projecting the item placement indicia for each of the one or more items to be packaged.

In some embodiments, the simultaneously projected item placement indicia are sequentially highlighted to identify which item is to be packaged next.

In some embodiments, projecting the item placement indicia comprises sequentially projecting the item placement indicia for the one or more items to be packaged.

In another example embodiment, a method for packaging items includes identifying one or more items to be packaged together, accessing an informational store and retrieving dimensional attribute information about each of the one or more items, virtually arranging the one or more items into a virtual arrangement, wherein virtually arranging the one or more items is performed using the dimensional information retrieved from the informational store, producing a customized package template sized particularly for the one or more items when the one or more items are arranged and positioned consistent with the virtual arrangement, providing access to the virtual arrangement to a robot, using the robot, placing the one or more items into the box according to the virtual arrangement, using the virtual arrangement as a guide for the placement of the at least one item in the box.

In some embodiments, the method also includes using the robot to place fill material into the box according to virtual arrangement.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for packaging items, the method comprising:
identifying one or more items to be packaged together;
accessing an informational store and retrieving dimensional attribute information about each of the one or more items;
virtually arranging the one or more items into a virtual arrangement, wherein virtually arranging the one or more items is performed using the dimensional information retrieved from the informational store;
producing a customized package template sized particularly for the one or more items when the one or more items are arranged and positioned consistent with the virtual arrangement, wherein producing the customized packaging template comprises:
forming one or more cuts and/or creates in a template material to create a template with a plurality of side wall panels and a plurality of flaps extending from the plurality of side wall panels;
applying item placement indicia on at least one of the plurality of side wall panels or at least one of the plurality of flaps, the item placement indicia representing a desired placement of at least one item of the one or more items; and
erecting the template into a box; and
placing the one or more items into the box according to the virtual arrangement, using the item placement indicia as a guide for the placement of the at least one item in the box.

2. The method of claim 1, further comprising calculating dimensions of the virtual arrangement.

3. The method of claim 2, wherein producing the customized package template comprises cutting and/or creasing the template material such that the erected box has interior dimensions that correspond to the calculated dimensions of the virtual arrangement.

4. The method of claim 1, wherein applying item placement indicia on at least one of the side wall panels comprises printing the item placement indicia on the at least one side wall panel or flap.

5. The method of claim 1, further comprising applying fill material indicia to one or more side wall panels of the plurality of side wall panels.

6. The method of claim 1, wherein applying the item placement indicia on at least one of the side wall panels or flaps comprises printing an outline, a picture, a description, one or more guide or shadow lines, or a combination thereof of the at least one item on the at least one side wall panel or flap.

7. The method of claim 1, wherein applying the item placement indicia on at least one of the side wall panels or flaps comprises printing colors and/or reference numbers associated the at least one item of the one or more items on the at least one side wall panel or flap.

8. A method for packaging items, the method comprising:
producing a customized package template sized particularly for one or more items when the one or more items are arranged and positioned consistent with a particular arrangement, wherein producing the customized packaging template comprises:
forming one or more cuts and/or creates in a template material to create a template with a plurality of side wall panels and a plurality of flaps extending from the plurality of side wall panels;
applying item placement indicia on at least one of the plurality of side wall panels or at least one of the plurality of flaps, the item placement indicia representing a desired placement of at least one item of the one or more items; and
erecting the template into a box; and
placing the one or more items into the box according to the virtual arrangement, using the projected item placement indicia as a guide for the placement of the at least one item in the box.

9. The method of claim 8, wherein applying item placement indicia on at least one of the side wall panels comprises printing the item placement indicia on the at least one side wall panel or flap.

10. The method of claim 8, further comprising applying fill material indicia to one or more side wall panels of the plurality of side wall panels.

11. The method of claim 8, wherein applying the item placement indicia on at least one of the side wall panels or flaps comprises printing an outline, a picture, a description, one or more guide or shadow lines, or a combination thereof of the at least one item on the at least one side wall panel or flap.

12. The method of claim 8, wherein applying the item placement indicia on at least one of the side wall panels or flaps comprises printing colors and/or reference numbers associated the at least one item of the one or more items on the at least one side wall panel or flap.

13. The method of claim 8, further comprising accessing an informational store and retrieving dimensional attribute information about each of the one or more items.

14. The method of claim 13, further comprising virtually arranging the one or more items into a virtual arrangement, wherein the particular arrangement is based on the virtual arrangement.

15. A method for packaging items, the method comprising:

providing a package template having a plurality of side wall panels and a plurality of flaps;

applying item placement indicia on at least one of the plurality of side wall panels or at least one of the plurality of flaps, the item placement indicia representing a desired placement of at least one item of a group of one or more items; and erecting the template into a box; and placing the one or more items into the box using the item placement indicia as a guide for the placement of the at least one item in the box.

16. The method of claim 15, wherein applying the item placement indicia comprises printing the item placement indicia.

* * * * *